US005833524A

United States Patent [19]

Satoh et al.

[11] Patent Number: 5,833,524

[45] **Date of Patent: *Nov. 10, 1998**

[54] DUST COLLECTION SYSTEM FOR A POWER TOOL

[75] Inventors: Hiroshi Satoh, Fuchu, Japan; Naoki Kikuchi; Kenneth M. Brazell, both of Chandler, Ariz.

[73] Assignee: Ryobi Limited, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 293,755

[22] Filed: Aug. 22, 1994

[51] Int. Cl.[6] ..... B24B 55/06

[52] U.S. Cl. ..... 451/456; 451/356; 285/184; 285/402

[58] Field of Search ..... 451/356, 357, 451/456, 359; 285/184, 360, 361, 376, 396, 401, 402; 200/561

[56] References Cited

U.S. PATENT DOCUMENTS

| | | | |
|---|---|---|---|
| 2,111,793 | 3/1938 | Lee et al. | 285/402 |
| 2,366,474 | 1/1945 | Bentley | 200/561 |
| 2,875,287 | 2/1959 | Van Sickle | 200/561 |
| 3,047,682 | 7/1962 | Hults | 200/561 |
| 4,164,100 | 8/1979 | Robert | 451/456 |
| 4,280,723 | 7/1981 | Moldestad | 285/402 |
| 4,660,329 | 4/1987 | Hutchins | 451/456 |
| 4,758,023 | 7/1988 | Vermillion | 285/401 |
| 4,860,400 | 8/1989 | Urakami | 451/456 |
| 4,905,420 | 3/1990 | Flachenecker et al. . | |
| 4,920,702 | 5/1990 | Kloss et al. . | |
| 5,123,216 | 6/1992 | Kloss et al. . | |
| 5,188,399 | 2/1993 | Durina | 285/402 |
| 5,218,790 | 6/1993 | Huang | 451/456 |
| 5,319,889 | 6/1994 | Rudolf et al. . | |
| 5,441,450 | 8/1995 | Fein et al. | 451/356 |

FOREIGN PATENT DOCUMENTS

| | | |
|---|---|---|
| 2365411 | 4/1978 | France . |
| 2262865 | 7/1973 | Germany . |
| 2742062 | 4/1981 | Germany . |
| 2426106 | 9/1984 | Germany . |
| 3540561 | 11/1985 | Germany . |
| 56-3174A | 1/1981 | Japan . |

*Primary Examiner*—Eileen P. Morgan
*Attorney, Agent, or Firm*—Brooks & Kushman P.C.

[57] ABSTRACT

A dust collection system for a power tool which comprises a drive unit, a body, a tool support, and a collection chute. The body defines an inlet opening and a discharge opening, the body having a communicating conduit located within the body which communicates the inlet opening with the discharge opening, and the body supporting the drive unit. The tool support is operably connected to the drive unit and defines a collection aperture, an exit opening which communicates directly with the inlet opening of the body during operational movement of the tool support, and a suction cavity in communication with both the collection aperture and the exit aperture. The collection chute has a collection end and a distal end, the collection end adapted to be connected to the body in a plurality of different positions in communication with the discharge opening of the body and the distal end adapted to be connected to the vacuum dust collector such that dust and other debris generated during operation of the power tool will be sucked sequentially through the collection aperture, the suction cavity, the communicating conduit, and out the collection chute.

12 Claims, 13 Drawing Sheets

FIG.13A1
FIG.13A2
FIG.13A3
FIG.13A4
FIG.13B1
FIG.13B2
FIG.13B3
FIG.13B4
18
19
13a
O1
O2
P
17
13

DUST COLLECTION SYSTEM FOR A POWER TOOL

TECHNICAL FIELD

This invention relates to a dust collection system for a power tool, and more particularly to a dust collection system for effectively collecting dust or other debris generated from the abrasive pad of a power tool such as the sanding pad of a detail sander.

BACKGROUND ART

Various approaches have been taken in the past to collect the dust generated by a power tool, especially a power tool which drives an abrasive pad. FIG. 14 shows one such dust collection system used in conjunction with a power detail sander. The detail sander comprises a body 1 having a handle portion and a tool support 2 oscillatingly connected to the body 1. The lower surface of the tool support 2 comprises a support pad surface to which a working member, such as a piece of sandpaper, may be attached and has apertures through which dust and other debris may be collected by suction. A vacuum conduit 10 communicates with the apertures in the lower surface of the tool support 2 and is connected to a dust collector (not shown) for collecting dust or other debris, sucked up through apertures in the bottom surface of the tool support 2, generated during operation.

This has several disadvantages. Because the vacuum conduit 10 is disposed below the body 1, the vacuum conduit 10 interferes with the grasping of the handle portion of the body 1 by an operator. This makes the handling of this detail sander unwieldy. Furthermore, the vacuum conduit 10 can catch on things and interfere with use of the detail sander. This not only interferes with use of the detail sander, it can cause the vacuum conduit to become disengaged from the body 1 during operation.

SUMMARY OF THE INVENTION

It is an object to provide a dust collection system for a power tool having a body and a tool support which allows dust or other debris can be sucked through the tool support and collected or discharged without interfering with the motion of the tool support, which allows a slim configuration of the handle portion of the body, and which does not interfere with handling of the power tool by an operator.

According to this invention, there is provided a dust collection system for a power tool, such as a detail sander, which can be connected to a vacuum dust collector. The dust collection system comprises a drive unit, a body, a tool support, and a collection chute. The body defines an inlet opening and a discharge opening, and has a communicating conduit located within the body which communicates the inlet opening with the discharge opening. The body also supports the drive unit. The tool support is operably connected to the drive unit and defines a collection aperture, an exit opening which communicates directly with the inlet opening of the body during operational movement of the tool support, and a suction cavity in communication with both the collection aperture and the exit aperture. The collection chute has a collection end and a distal end, the collection end adapted to be connected to the body in a plurality of different positions in communication with the discharge opening and the distal end adapted to be connected to the vacuum dust collector such that dust or other debris generated during operation of the power tool will be sucked sequentially through the collection apertures, the suction cavity, the communicating conduit, and out the collection chute.

It is preferable that the portion of the body not housing the communicating passage or communicating conduit constitute a handle portion which can have a smaller cross-section than the remainder of the body.

When in use, the distal end of the dust chute is connected to a dust collection machine and the tool support is oscillated by the drive unit. In this system, the operational movement of the tool support is not interfered with because no vacuum conduit or tubing is connected to the tool support. Furthermore, because the dust chute is connected to the discharge opening in front of the handle portion, the handle portion can be compactedly formed so that it can be easily grasped by a user. Also, if the dust chute is rotatably connected to the discharge opening, the vacuum tube can be disposed in a position which does obstruct the operation of the power tool by the operator.

In another preferred embodiment of the invention, the power tool has an actuator switch to activate or deactivate a drive unit of the power tool. The actuator switch comprises a switch member having a knob end which protrudes through a switch opening in the body, and an engagement end which operably engages a slide switch activatingly connected to the drive unit. The switch member also has a pivot structure located between the knob end and the engagement end which is pivotally connected to the body such that the knob end may be moved back and forth transversely to the longitudinal axis of the body thereby activating or deactivating the drive unit via corresponding movement of the engagement end of the switch member which operably engages the lever of the slide switch.

By using such an actuator switch, the switch member of which may be elongated, the knob end of the switch member may be located away from the tool support, thereby isolating the actuator switch from dust or debris. Another benefit stemming from this actuator switch is that the side-to-side operation of the knob end transverse to the axis of the body, as opposed to a back-to-front operation parallel to the axis of the body, minimizes the chance of an operator accidentally turning the power tool on or off.

The nature, utility, and further features of this invention will be more clearly apparent from the following detailed description with respect to preferred embodiments of the invention when read in conjunction with the accompanying drawings briefly described below.

BRIEF DESCRIPTION OF THE DRAWINGS

In the accompanying drawings:

FIGS. 13A1 to 13A4 are sectional views showing the conversion of the motor rotation to the pivotal oscillating motion of the pivot arm, taken along line 13A–13A of FIG. 4;

FIGS. 13B1 to 13B4 are plan views corresponding to FIGS. 13A1 to 13A4, respectively;

BEST MODE FOR CARRYING OUT THE INVENTION

Figure 1:
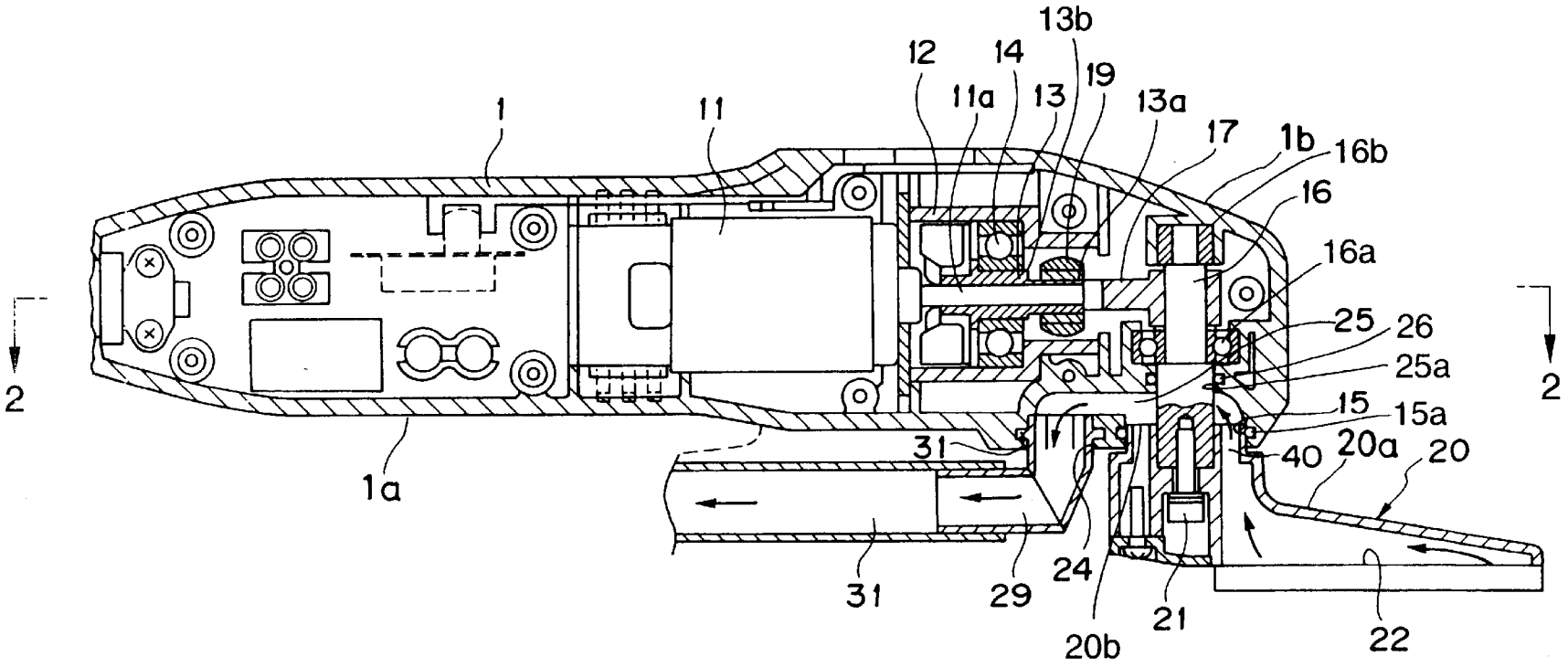
FIG. 1 is an elevational section of an improved power tool, a detail sander, having a dust collection system of the present invention.
Figure 2:
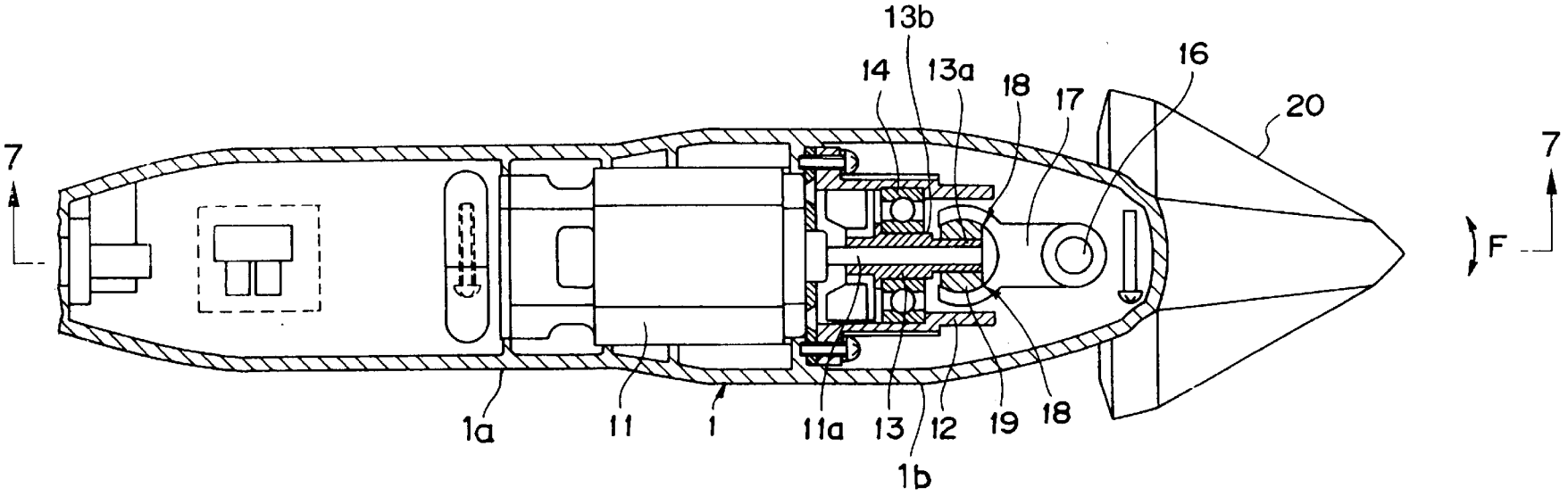
FIG. 2 is a sectional view taken along line 2—2 of FIG. 1.
Figure 4:
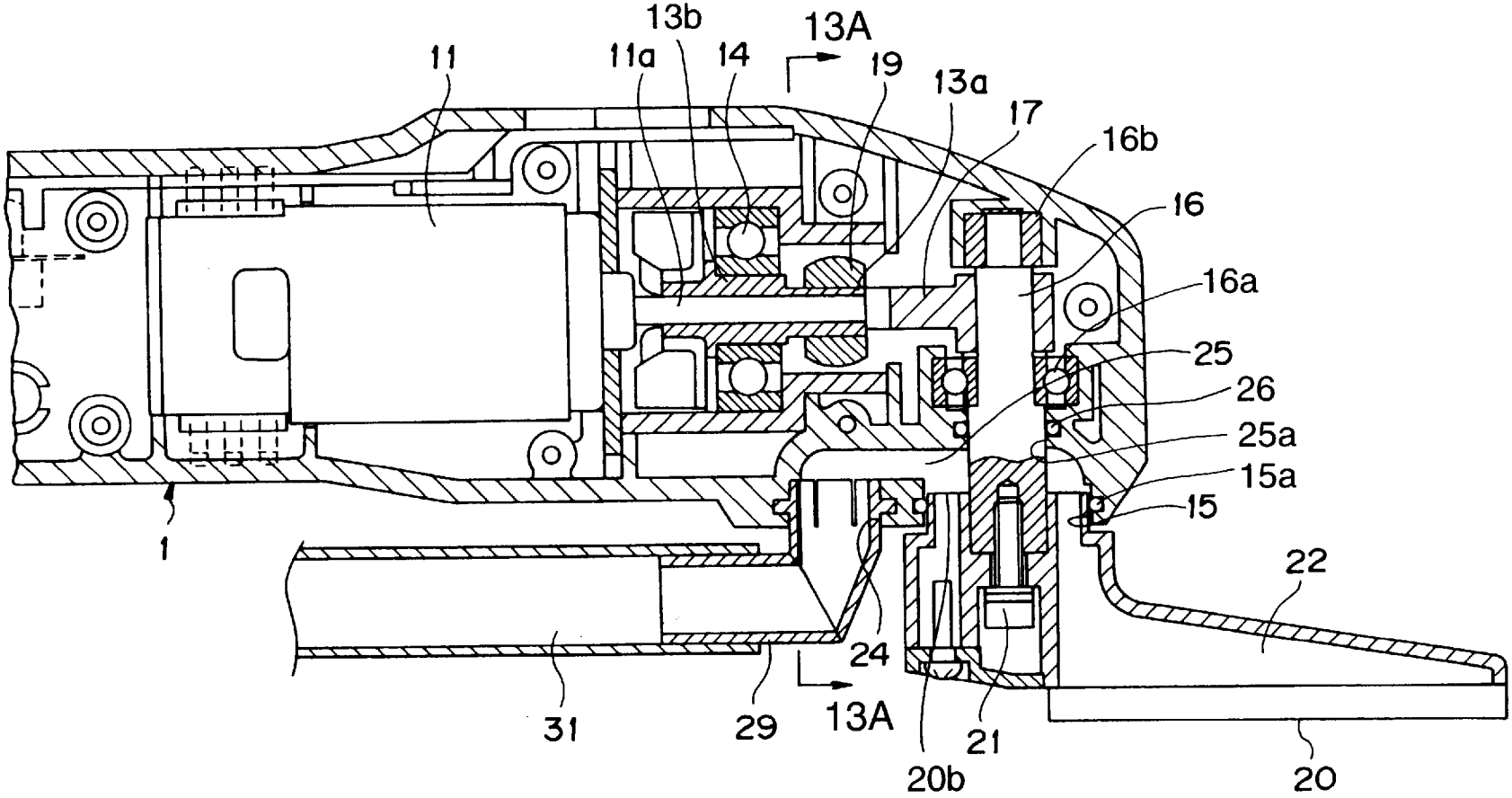
FIG. 4 is an enlargement of the section of the head portion of the body of the improved power tool shown in FIG. 2.
Figure 13:
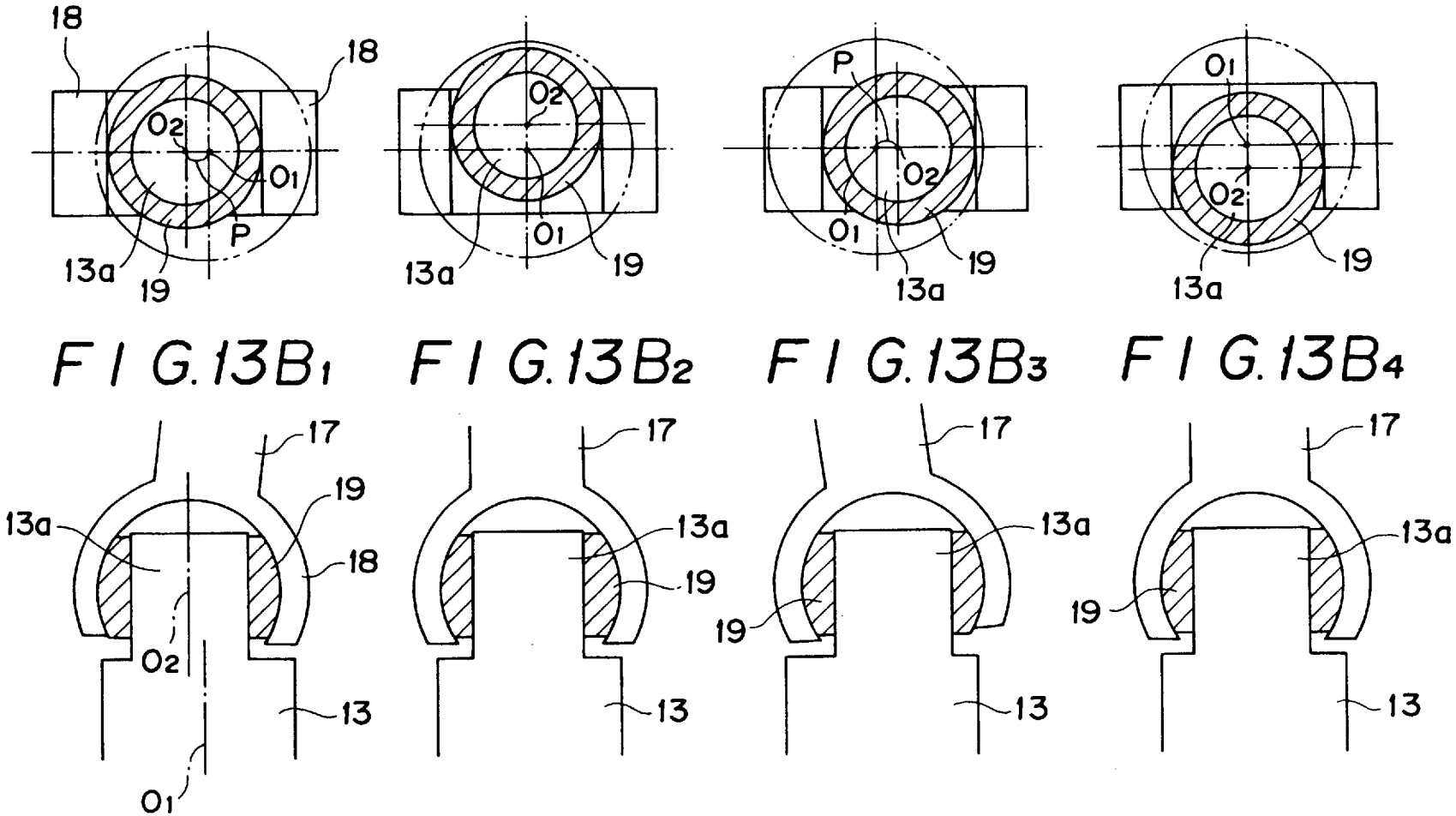
Figure 14:
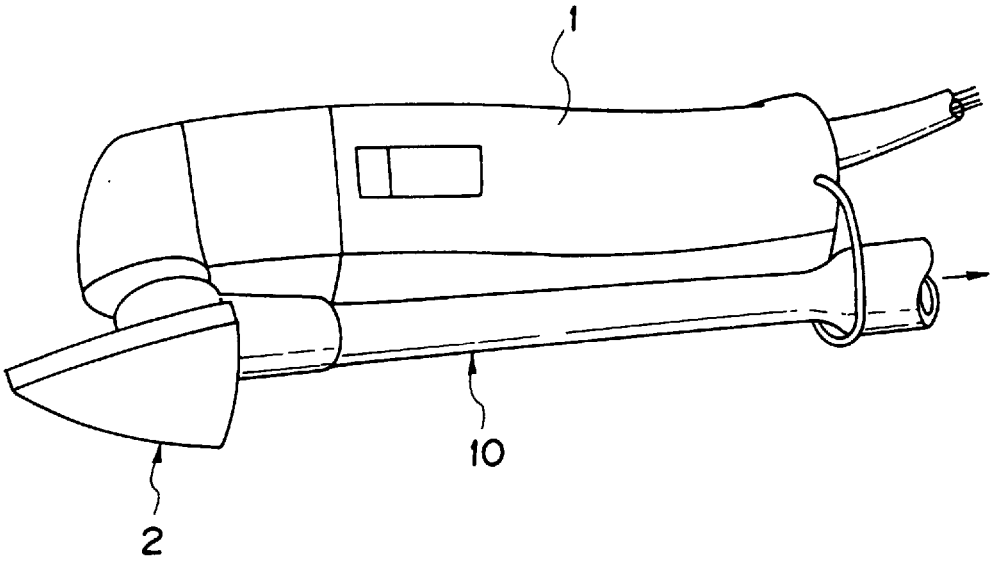
FIG. 14 PRIOR ART
FIG. 14 is a perspective view of a conventional prior art detail sander.

FIGS. 1 to 13B4 show an embodiment in which the dust collection system of this invention is adapted to a detail sander for detail sanding and sanding in corners. As shown in FIGS. 1 and 2, a body 1 comprises a handle portion 1*a* which an operator may grasp with his hand and a head portion 1*b* integrally formed in front of the handle portion 1*a*. The head portion 1*b* supports a tool support 20 which is the operating member for performing sanding work.

The handle portion 1*a* houses a drive unit which in this embodiment is a DC motor 11, and the head portion 1*b* houses a converter box 12 disposed on the output side of the DC motor 11 for converting the rotation of the DC motor 11 to the oscillating motion of the tool support 20 about a pivot axis.

The DC motor has an output shaft 11*a* which extends into the transfer box. A drive shaft 13 having an eccentric portion 13*a* and a cylindrical portion 13*b* is connected to the output shaft 11*a* of the DC motor 11. The cylindrical portion 13*a* of the drive shaft 13 is disposed rotatably through shaft bearings 14 supported in turn by the converter box 12. As best shown in FIGS. 13A1 to 13A4 and 13B1 to 13B4, and as will be more fully explained later, the eccentric portion 13*a* of the drive shaft 13 is eccentric to the axis of the drive shaft 13.

The head portion 1*b* also accommodates a support shaft 16 which extends perpendicularly to the drive shaft 13 and which projects downwardly through an inlet opening 15 formed at the lower face of the head portion 1*b*. The tool support 20 is fixedly connected by a screw 21 to the projecting portion of the support shaft 16. The upper portion of the support shaft 16 is pivotally mounted within the head portion 1*b*, such as through the use of shaft bearings 16*a* and a shaft bushing 16*b*. Because such pivotal mountings are generally known in the art, no further discussion will be undertaken here.

Figure 5:
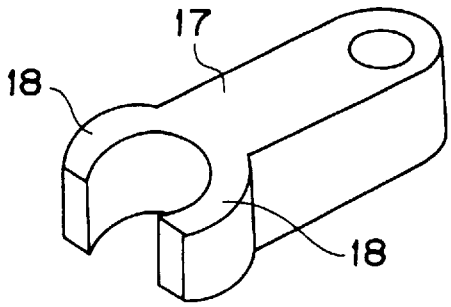
FIG. 5 is a perspective view of a pivot arm used in this invention.

A pivot arm 17 is fixedly connected to the upper portion of the support shaft 16 by press fitting the pivot arm 17 onto the support pin shaft. As shown in FIGS. 2 and 5, the pivot arm 17 is provided integrally with a pivot cup 18 formed so that the front portion of the pivot arm 17 is branched in an arc-like manner into two arms as shown in FIG. 5. As best shown in FIGS. 1, 2, 13A1 to 13A4 and 13B1 to 13B4 a slide ring 19, which may be made from steel, is rotatably connected to the eccentric portion 13*a* of the drive shaft 13 and slidingly engages the inner surface of the pivot cup 18. As a result, when the eccentric portion 13*a* of the drive shaft 13 is eccentrically rotated by the drive shaft 11*a* of the DC motor 11, the pivot arm 17, support shaft 16 and tool support 20 are oscillated about the axis of the support pin shaft via the slide ring 19.

Figure 6:
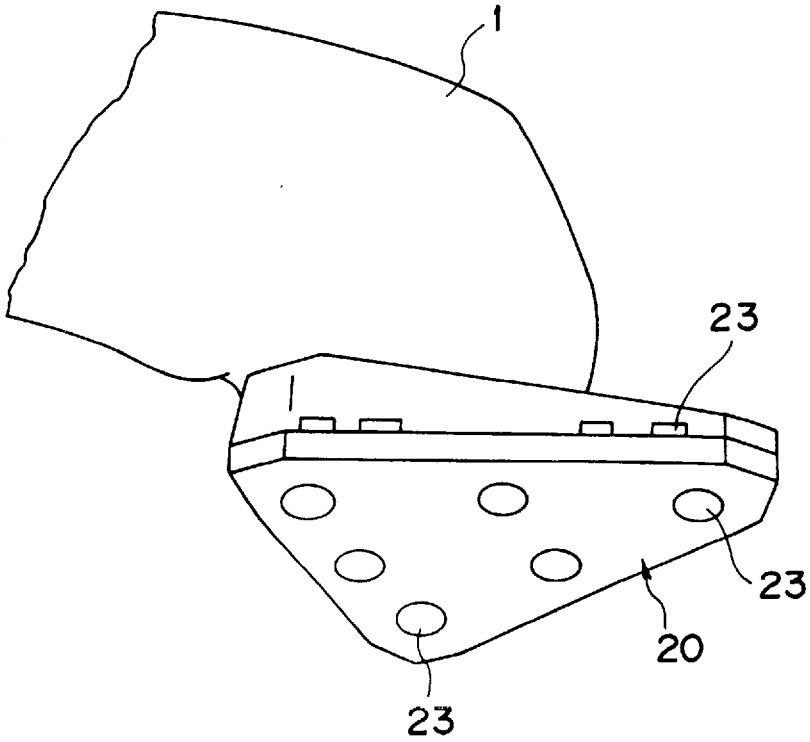
FIG. 6 is a perspective view showing the bottom of a tool support of the present invention.

As shown in FIGS. 2 and 6 the tool support 20 has an approximately triangular shape. A working member, such as an abrasive sandpaper pad, can be attached to the operating surface of the tool support 20, through the use of an adhesive or some other commonly known method, to form an operating surface for performing detail sanding or other tasks. The tool support 20 has a supporting portion 20*a*, extending upright in the shape of cylinder, which pivotally engages an annular O-ring seal 15*a* provided at this pivotal connection to minimize air leakage. Because such annular O-ring seals are generally known in the art, no further discussion will be undertaken here.

Figure 3:
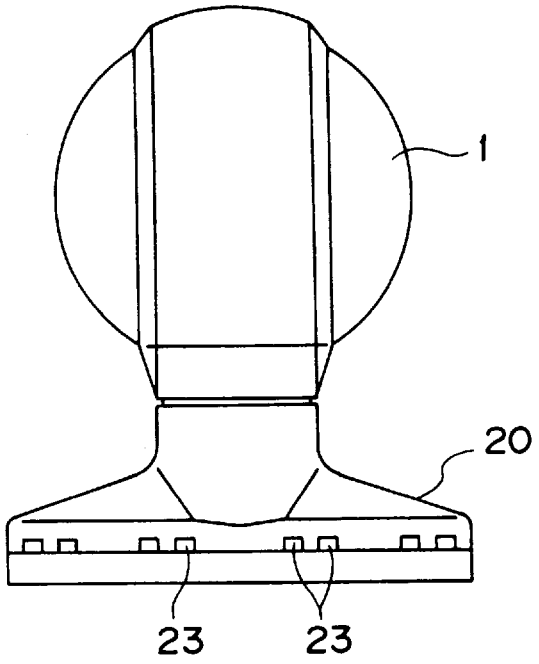
FIG. 3 is a front view of the detail sander shown in FIG. 1.

As shown in FIGS. 3 and 6, the tool support 20 defines a plurality of collection apertures 23 formed through the operating surface and the side face of the tool support 20. The tool support 20 also has an exit opening 20*b* defined by the supporting portion 20*a* of the tool support, and a suction cavity 22 which communicates with both the collection apertures 23 and the exit opening 20*b*. The inlet opening 15 is connected to a communicating conduit 25 which is formed within the head portion 1*b* of the body 1. The other end of the communicating conduit 25 is connected to a discharge opening 24 defined by the head portion 1*b* of the body 1 rearward of the inlet opening 15. The suction cavity 22 communicates with the communicating conduit 25 via an annular communicating space 40 around the projecting portion of the support shaft 16 at the connection between the inlet opening 15 of the body 1 and the exit opening 20*b* of the tool support 20. An annular O-ring seal 26 which allows the support shaft to rotate is provided at the opening 25*a* provided in the roof of the communicating conduit 25 through which the support shaft 16 passes. Accordingly, the suction cavity 22, the annular connecting space 40 and the communicating conduit 25 form a communicating passage for collecting dust or other debris. The portion of the body 1 rearward the discharge opening 24 forms the handle portion 1*a*.

Figure 7:
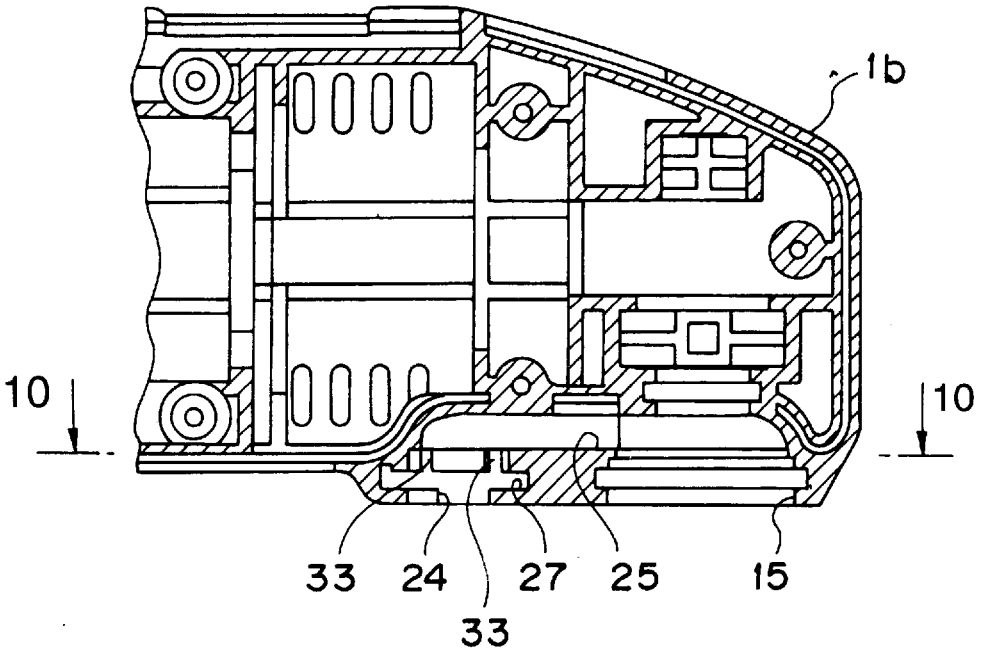
FIG. 7 is a sectional view of the head portion of the body of the power tool, without a tool support or collection chute attached, taken along line 7–7 of FIG. 2.
Figure 8:
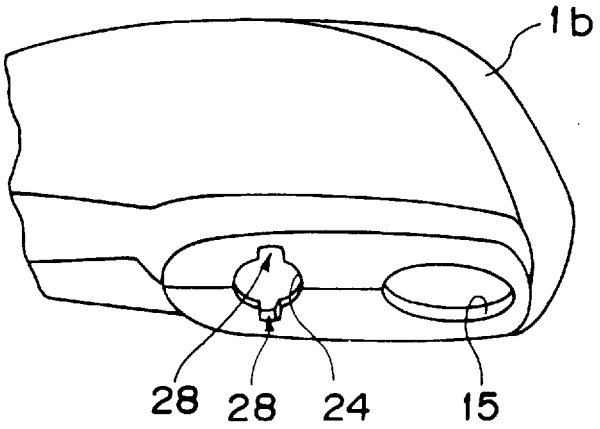
FIG. 8 is a perspective view of the lower face of the head portion of the body of the power tool, without the tool support or collection chute attached.
Figure 10:
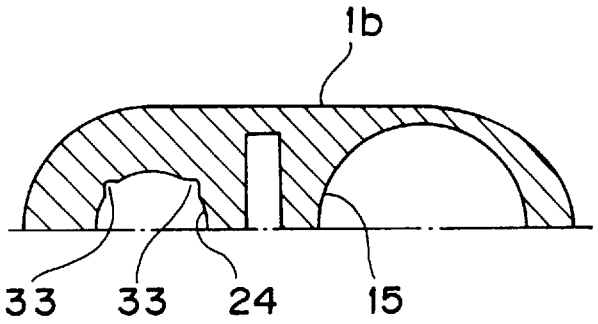
FIG. 10 is a partial sectional view of the head portion of the body of the power tool, taken along line 10—10 of FIG. 7.

As shown in FIGS. 7 and 8, the discharge opening 24 is provided with an annular discharge groove 27 on its inner peripheral surface, and a pair of diametrically opposed keyways 28 formed perpendicular to the longitudinal axis of the body 1. As shown in FIGS. 7 and 10, chute locating grooves 33 are formed on the inner surface of the upper portion of the discharge opening 24 over the annular discharge groove 27.

Figure 11A:
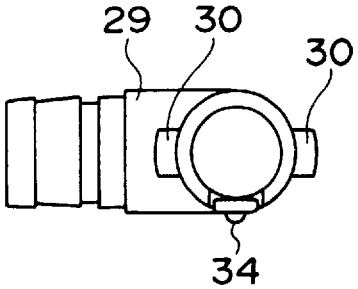
FIG. 11A is a plan view of the collection chute.
Figure 11B:
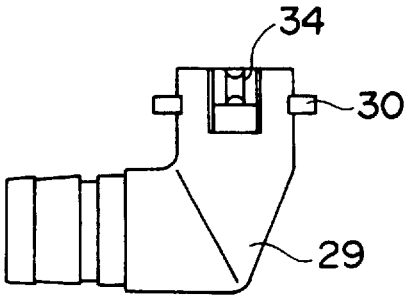
FIG. 11B is a side elevational view of the collection chute.
Figure 11C:
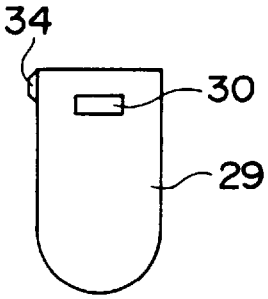
FIG. 11C is a front elevational view of the collection chute.

As shown in FIGS. 11A, 11B, and 11C, an L-shaped collection chute 29 (FIG. 11), which may be made from any suitable material, such as a suitable plastic, has integral engaging keys 30 projecting at diametrically opposed positions parallel to the axis of the collection chute. An engaging projection 34 is formed between the two engaging keys 30 at a position above the engaging keys 30. To use the collection chute 29, the two engaging keys 30 are inserted through the keyways 28 of the discharge opening 24. The collection chute 29 is then rotated to engage the engaging keys 30 within the annular discharge groove 27 of the discharge opening 24 whereby the collection chute 29 is held rotatably in the discharge opening 24. The engaging projection 34 of the collection chute 29 may be engaged with one of chute locating grooves 33 to hold the collection chute 29 at a predetermined rotational position such as the positions shown in FIGS. 9A and 9B. While only two chute locating grooves 33 are shown in this embodiment, the number of locating grooves is not restricted, and the number may be more or less than two. As shown in FIG. 1, the distal end of the collection chute 29 may be connected to a vacuum tube 31 which in turn extends from, or is connected to, a vacuum dust collector apparatus or machine (not shown).

Figure 12:
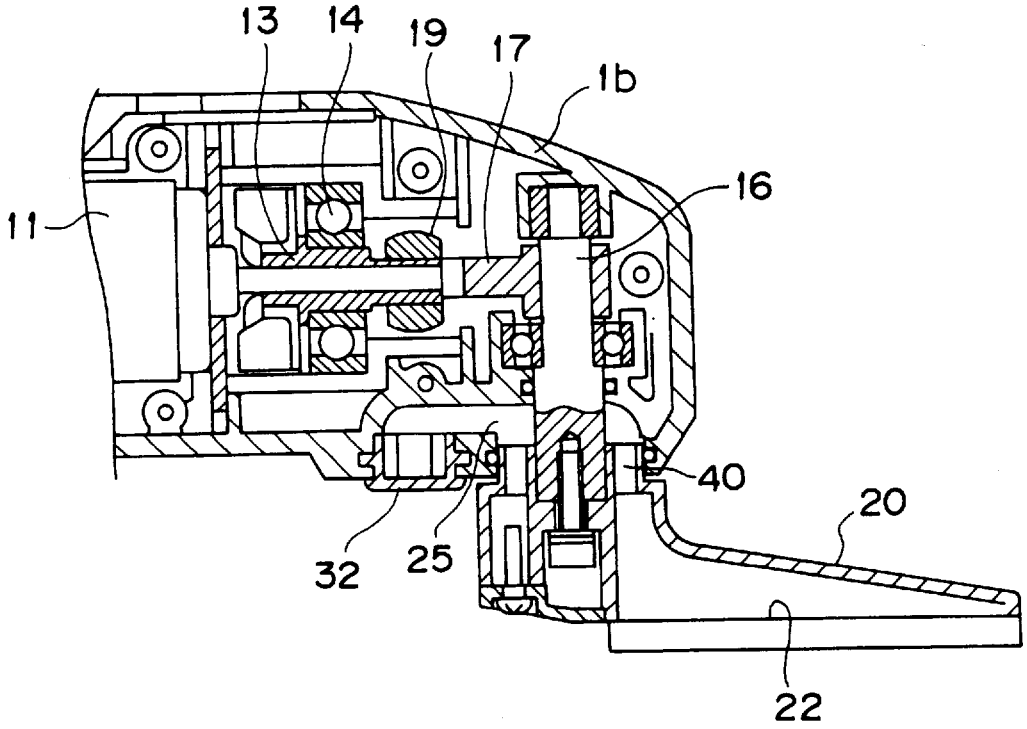
FIG. 12 is an sectional view of the head portion of the body of the power tool showing a cap attached to the body discharge aperture.

In the event that it is not desired to use the dust collection features of this invention, the collection chute 29 may be removed from the discharge opening 24 and replaced with a cap or cover 32 as shown in FIG. 12.

The operation of this embodiment of the invention can now be explained.

First, the DC motor 11 is turned on, using the actuator switch disclosed in this specification or any other suitable switch known in the art, to rotate the output shaft 11*a* and drive shaft 13 which thereby moves the slide ring 19 eccentrically due to the eccentric portion 13*a* of the drive shaft 13. As a result, the cup 18 of the pivot arm 17, the pivot arm 17 itself, and the support shaft 16, are oscillated about the axis of the support shaft 16.

FIGS. 13A1 to A4 show sectional views taken along line 13A–13A of FIG. 4, and FIGS. 13B1 to B4 shown plan views corresponding to FIGS. 13A1 to A4 respectively. In FIGS. 13A1 to 13A4, the center of the drive shaft 13 and the center of the eccentric portion 13*a* are indicated by $\mathbf{0}_1$ , and $\mathbf{0}_2$ respectively.

When the eccentric portion 13*a* of the drive shaft 13 is rotated by 90° in the clockwise direction from the position shown in FIG. 13A1 to the position shown in FIG. 13A2, the eccentric portion 13*a* and the slide ring 19 assume the respective positions shown in FIGS. 13A2 and B2. Accordingly, the cup 18 of the pivot arm 17 is moved by a distance P as shown in FIGS. 13A1 and 13B1. When the drive shaft 13 is rotated by another 90° in the clockwise direction from the position shown in FIGS. 13A2 and B2, the eccentric portion 13*a* and the slide ring 19 assume the positions shown in FIGS. 13A3 and B3. Accordingly, the cup 18 of the pivot arm 17 is moved again by a distance P from the position shown in FIGS. 13A2 and B2. When the drive shaft 13 is rotated by another 90° in the clockwise direction from the position shown in FIGS. 13A3 and B3, the eccentric portion 13*a* and the slide ring 19 assume the positions shown in FIGS. 13A4 and B4. In this manner, the rotation of the drive shaft 13 is converted to the oscillating motion of the cup 18 of the pivot arm 17 with a range of 2P. The oscillating motion of the pivot arm 17 causes the support shaft 16 to oscillate the tool support 20 about the axis of the support shaft 16 as indicated by the directional arrow F shown in FIG.2. As a result, the desired abrasive, sanding or polishing work can be carried out.

When the vacuum dust collector (not shown) is turned on, dust or other debris generated from use of the invention is sucked through the collection apertures 23, the suction cavity 22, the communicating conduit 25, the vacuum tube 31 and the collection chute 29 and the vacuum tube 31 to be discharged into a collection receptacle or filter (not shown) or any other desired location. Because the dust or other debris is sucked from the collection apertures 23 of the tool support 20 and, via the suction cavity 22, directly into the communicating conduit 25 located within the body 1, this system does not interfere with the oscillating motion of the tool support 20. Also, because the vacuum tube 31 is not connected to the oscillating tool support, but is instead connected to the stationary head portion 1*b* of the body 1, the vacuum tube will not become disengaged due to the oscillating motion of the tool support 20. As a result, the tool support 20 can be operated reliably and safely, and dust or other debris can be collected and discharged away from the work area.

Figure 9A:
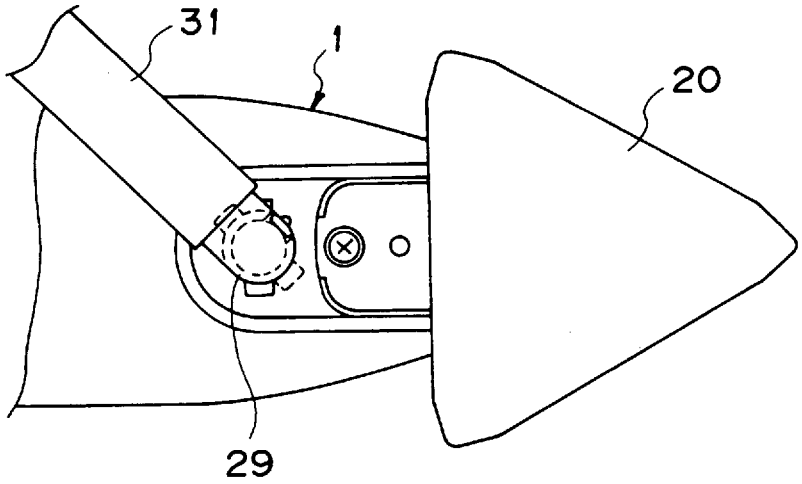
FIGS. 9A and 9B are bottom views of the head portion of the body and the tool support of the power tool, showing different rotational positions of the collection chute.
Figure 9B:
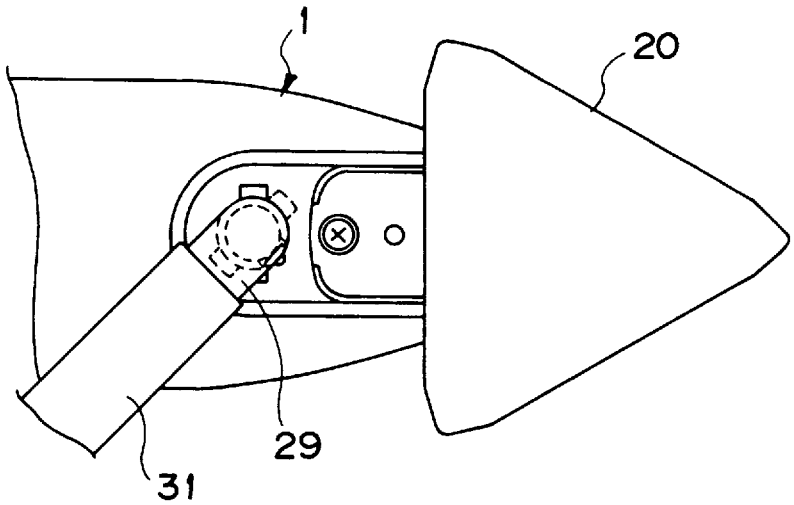

Since the discharge opening 24 is provided on the lower face of the head portion 1*b* of the body 1, and tubes for collecting dust are not disposed in the handle portion of the body 1, the diameter of handle portion 1*a* of the body 1 can be minimized to aid the user in grasping the handle portion 1*a* of the body 1. In addition, because the collection chute 29 rotatably engages the discharge opening 24, the collection chute 29 can be rotated with respect to the longitudinal axis of the body 1, as shown in FIGS. 9A and 9B, to locate the collection chute 29 and any connected vacuum tube 31 in a position to prevent them from obstructing use of the invention by the operator.

Furthermore, as shown in FIGS. 3 and 6, some of the collection apertures 23 of this embodiment are located in the side face of the tool support 20, in addition to the collection apertures 23 located in the operating surface of the tool support 20. As a result, dust or other debris which accumulates in a corner location can be readily and reliably collected.

Figure 15:
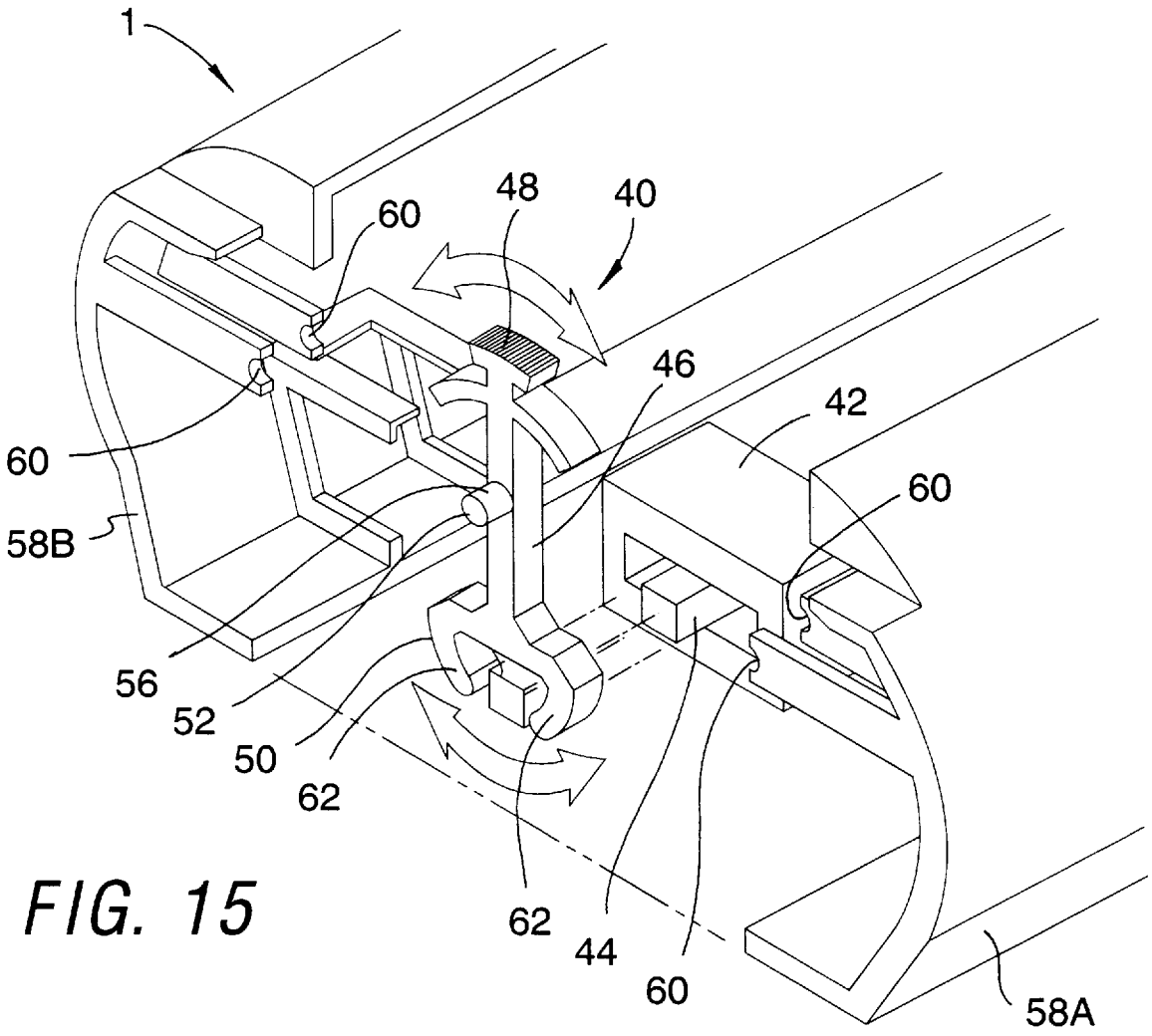
FIG. 15 is a perspective view of an actuator switch used to activate or deactivate the power tool.
Figure 16:
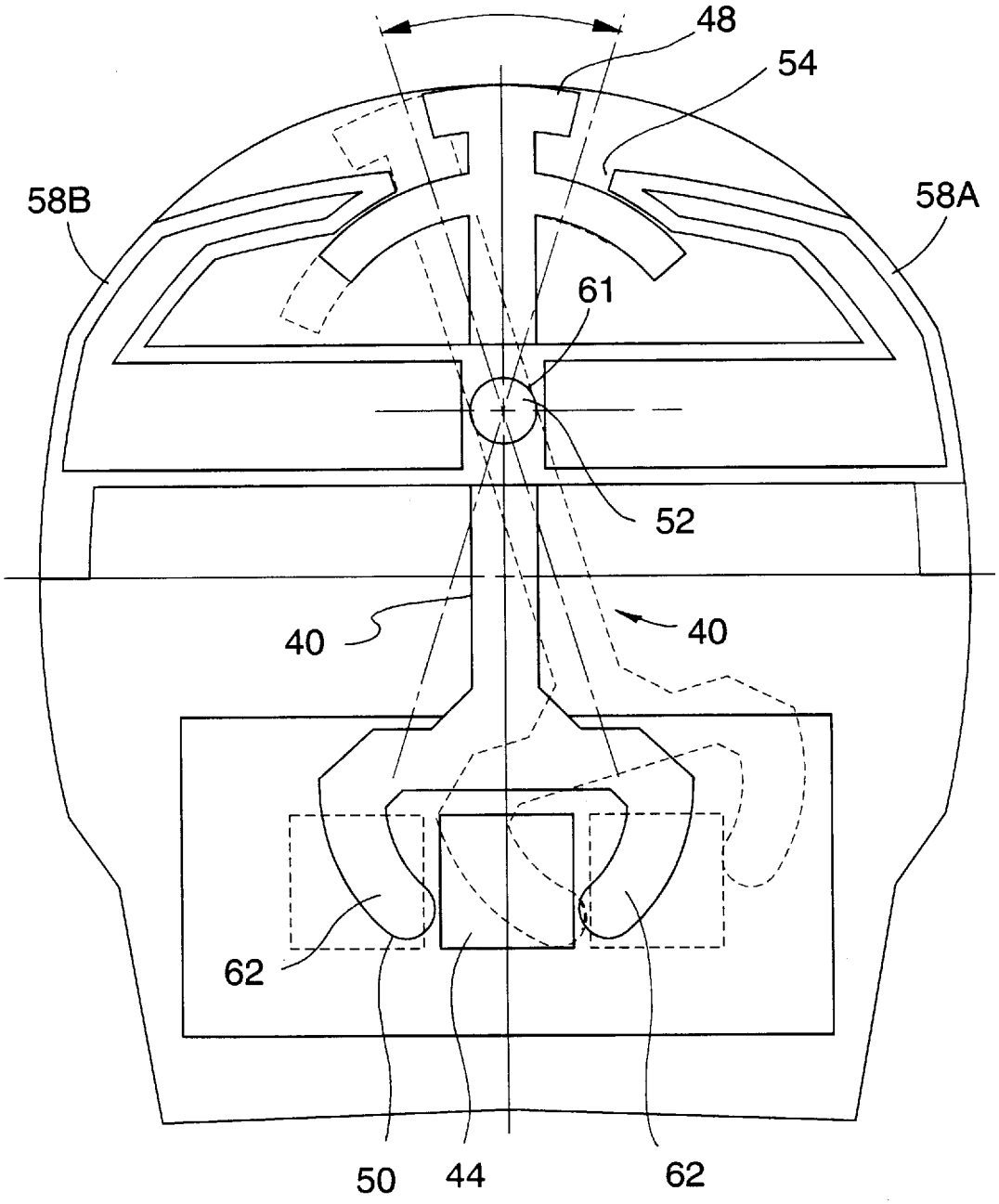
FIG. 16 is an elevational view of the actuator switch shown in FIG. 15.

FIGS. 15 and 16 show an actuator switch 40 which may be used to activate or deactivate the drive unit, in this case the DC motor 11 (not shown in these figures), of a power tool. In this embodiment, the body 1 of a power tool contains a slide switch 42 having a lever 44 which is activatingly connected to the drive unit.

The actuator switch 40 comprise a switch member 46 which has a knob end 48, an engagement end 50, and a pivot structure 52 located between the knob end 42, and the engagement end 50. As shown in FIGS. 15 and 16, the knob end 48 protrudes through a switch opening 54 formed through the body 1.

The pivot structure comprises cylindrical projections 56. The body 1 of this embodiment is comprised of two clam shell halves 58A and 58B having semi-cylindrical recesses 60 which pivotably surround the cylindrical projections 56 of the pivot structure 52, and thereby form a pivot bore 61, when the clam shell halves 58A and 58B are assembled together.

The engagement end 50 of the switch member 46 operably engages the lever 44 at the slide switch 42. In the embodiment shown, the engagement end 50 engages the slide switch 42 via two arms 62 abutting each side of the lever 44 of the slide switch 42.

By such assembly, and as shown in FIGS. 15 and 16, the knob end 48 of the switch member can be moved transversely to the longitudinal axis of the body 1 such that the switch member 46 is moved pivotally about the pivot structure 52. By moving the knob end 48 of the switch member 46 back and forth, the user may activate or deactivate the drive unit of the power tool via the corresponding movement of the arms 62 of the engagement end 50 which operably engages the lever 44 of the slide switch 42 of the power tool.

Figure 17:
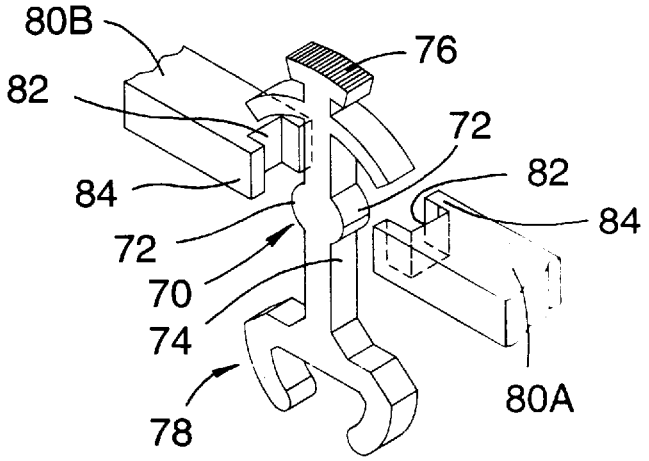
FIG. 17 is a perspective view of an alternative embodiment of an actuator switch.

FIG. 17 shows an alternative actuator switch which is identical to the actuator switch shown in FIGS. 15 and 16 with the exception of the pivot structure 70 which, in this case, comprises a semi-cylindrical projection 72 on each side of the switch member 74 between the knob end 76 and engagement end 78. The body of this embodiment is likewise comprised of two clam shell halves 80A and 80B (partially shown) having semi-cylindrical recesses 82 which may, as shown, have end projections 84 which totally enclose the pivot structure 70 of the switch member 74 and thereby form a cylindrical recess when the clam shell halves 80A and 80B are assembled together. This has the desirable effect of minimizing any dust or debris from entering the internal cavity of body 1. To further create a dust tight seal, the semi-cylindrical projection 72 is preferably coated with grease before being sealed within the cylindrical recess formed by the clam shell halves 80A and 80B.

As is readily apparent, a variety of dust collection systems using the disclosed invention are possible depending upon the type of work being performed and the particular power tool. While the best mode for carrying out the invention has been described in detail, those familiar to the art to which this invention relates will recognize various alternative designs and embodiments for practicing the invention as defined by the following claims.

What is claimed is:

1. A dust collection system for a power tool which can be connected to a vacuum dust collector, the dust collection system comprising:

a drive unit;

a body defining an inlet opening and a discharge opening, the body having a communicating conduit located within the body which communicates the inlet opening with the discharge opening, the body housing the drive unit, and the discharge opening having an annular discharge groove, a keyway and a plurality of locating grooves, each locating groove being in a different position and being aligned parallel to a longitudinal axis of the discharge opening;

a tool support operably connected to the drive unit and defining a collection aperture, an exit opening which communicates directly with the inlet opening of the body during operational movement of the tool support, and a suction cavity in communication with both the collection aperture and the exit opening;

a support shaft fixedly connected to the tool support, pivotally connected to the body, and operatingly driven by the drive unit, the support shaft being located such that it extends through, without blocking communication between, the inlet opening of the body and the exit opening of the tool support; and a collection chute having a collection end and a distal end, the collection end adapted to be connected to the body in a plurality of rotational positions and in communication with the discharge opening, defining an engaging key to be inserted through the keyway of the discharge opening so that the collection chute may be rotated to engage the engaging key within the annular discharge groove of the discharge opening whereby the collection chute is held rotatably in the discharge opening, the collection end of the collection chute having an outer peripheral surface which defines an engaging projection, so that the collection chute may be held at a selected one of the predetermined rotational positions by engagement of the engaging projection with a selected one of the locating grooves, whereby the collection chute can be set at a selected one of predetermined rotational positions that is not obstructing during the operational movement, and the distal end adapted to be connected to the vacuum dust collector such that dust and other debris generated during operation of the power tool will be sucked sequentially through the collection aperture, the suction cavity, the communicating conduit, and out the collection chute.

2. A dust collection system according to claim 1, wherein the tool support has an operating surface and a side face and the collection aperture is formed through at least the side face of the tool support.

3. A dust collection system according to claim 1, further comprising a flexible vacuum tube adapted to be connected in communication with the distal end of the collection chute and the vacuum dust collector.

4. A dust collection system according to claim 1, wherein a cap can be mounted on the discharge opening in lieu of the collection chute.

5. A dust collection system according to claim 1, wherein the body has a handle portion and a head portion, the head portion of which defines the inlet opening and the discharge opening, and the communicating conduit is located within the head portion.

6. A dust collection system according to claim 1, wherein the body defines a switch opening and further comprising a slide switch activatingly connected to the drive unit, and an actuator switch comprising a switch member having a knob end which protrudes through the switch opening, an engagement end which operably engages the slide switch, and a pivot structure located between the knob end and the engagement end and which pivotally engages the body such that the knob end may be moved back and forth transversely to the longitudinal axis of the body thereby activating or deactivating the drive unit via corresponding movement of the engagement end which operable engages the slide switch.

7. A dust collection system collection system according to claim 1, wherein the collection end is adapted to be connected to the body in a plurality positions.

8. A dust collection system for a power tool which can be connected to a vacuum dust collector, the dust collection system comprising:

a drive unit;

a body having a handle portion and a head portion, the head portion defining an inlet opening and a discharge opening which can be connected to the vacuum dust collector, the head portion having a communicating conduit located within the head portion which communicates the inlet opening with the discharge opening, the body housing the drive unit, and the discharge opening having an annular discharge groove, a keyway and a plurality of locating grooves, each locating groove being in a different position and being aligned parallel to a longitudinal axis of the discharge opening;

a tool support operably connected to the drive unit and having an operating surface and a side face which define a collection aperture, the tool support defining an exit opening which communicates directly with the inlet opening of the head portion of the body during operational movement of the tool support, and the tool support defining a suction cavity in communication with both the collection aperture and the exit opening;

a support shaft located such that it extends through, without blocking, the communication of the inlet opening of the head portion of the body and the exit opening of the tool support, the support shaft being fixedly connected to the tool support, pivotally connected to the body, and operatively driven by the drive unit; and a collection chute having a collection end and a distal end, the collection end adapted to be connected to the head portion of the body in a plurality of rotational positions and in communication with the discharge opening, defining an engaging key to be inserted through the keyway of the discharge opening so that the collection chute may be rotated to engage the engaging key within the annular discharge groove of the discharge opening whereby the collection chute is held rotatably in the discharge opening, the collection end of the collection chute having an outer peripheral surface which defines an engaging projection, so that the collection chute may be held at a selected one of the predetermined rotational positions by engagement of the engaging projection with a selected one of the locating grooves, whereby the collection chute can be set at a selected one of predetermined rotational positions that is not obstructing during the operational movement, and the distal end adapted to be connected to the vacuum dust collector such that dust and other debris generated during operation of the power tool will be sucked sequentially through the collection aperture, the suction cavity, the communicating conduit, and out the collection chute.

9. A dust collection system according to claim 8, further comprising a flexible vacuum tube adapted to be connected in communication with the distal end of the collection chute and the vacuum dust collector.

10. A dust collection system according to claim 8, wherein a cap can be mounted on the discharge opening in lieu of the collection chute.

11. A dust collection system according to claim 8, wherein the body defines a switch opening and further comprising a slide switch activatingly connected to the drive unit, and an actuator switch comprising a switch member having a knob end which protrudes through the switch opening, an engagement end which operably engages the slide switch, and a pivot structure located between the knob end and the engagement end and which pivotally engages the body such that the knob end may be moved back and forth transversely to the longitudinal axis of the body thereby activating or deactivating the drive unit via corresponding movement of the engagement end which operable engages the slide switch.

12. A dust collection system according to claim 8, wherein the collection end is adapted to be connected to the head portion of the body in a plurality of different positions.

* * * * *